US007287532B2

(12) United States Patent
Hafemann

(10) Patent No.: US 7,287,532 B2
(45) Date of Patent: Oct. 30, 2007

(54) DEVICE FOR APPLICATION OF HAIR CURLERS

(75) Inventor: Klaus Hafemann, Essen (DE)

(73) Assignee: WIK Far East Ltd., Hong Kong (CN)

( * ) Notice: Subject to any disclaimer, the term of this patent is extended or adjusted under 35 U.S.C. 154(b) by 239 days.

(21) Appl. No.: 11/075,563

(22) Filed: Mar. 9, 2005

(65) Prior Publication Data

US 2005/0199257 A1 Sep. 15, 2005

(30) Foreign Application Priority Data

Mar. 9, 2004 (DE) ..... 20 2004 003 593 U

(51) Int. Cl.
*A45D 1/04* (2006.01)
*A45D 20/08* (2006.01)

(52) U.S. Cl. ..... 132/232; 132/271

(58) Field of Classification Search ..... 132/227, 132/234, 232, 263, 226, 271, 148, 219; 219/222, 219/225–229

See application file for complete search history.

(56) References Cited

U.S. PATENT DOCUMENTS

| | | | | |
|---|---|---|---|---|
| 4,354,092 | A | 10/1982 | Manabe et al. | |
| 4,632,135 | A * | 12/1986 | Lenting et al. | 132/313 |
| 4,884,583 | A | 12/1989 | Long, Jr. | |
| 5,286,949 | A | 2/1994 | Simons | |
| 5,884,635 | A | 3/1999 | O'Brian et al. | |
| 5,941,253 | A | 8/1999 | Kaizuka | |
| 5,975,090 | A * | 11/1999 | Taylor et al. | 132/116 |
| 6,186,150 | B1 | 2/2001 | Lo | |
| 6,499,195 | B1 | 12/2002 | Wong | |
| 6,881,928 | B2 | 4/2005 | Wong et al. | |
| 6,907,888 | B2 * | 6/2005 | Saida et al. | 132/271 |
| 2004/0118425 | A1 | 6/2004 | Santhouse et al. | |
| 2005/0000954 | A1 | 1/2005 | Schmitz | |
| 2005/0011534 | A1 | 1/2005 | Kampel | |

FOREIGN PATENT DOCUMENTS

| | | |
|---|---|---|
| DE | 3047268 A1 | 12/1980 |
| DE | 81 16 335.5 | 2/1981 |
| DE | 203 01 440.6 | 1/2004 |
| DE | 04000490.5-1260 | 4/2004 |
| DE | 2003 01 400 U1 | 7/2004 |
| GB | 571894 | 9/1945 |
| WO | WO 03/101242 A2 | 5/2003 |

* cited by examiner

*Primary Examiner*—Robyn Doan
(74) *Attorney, Agent, or Firm*—Margaret Polson; Patent Law Offices of Rick Martin, PC

(57) ABSTRACT

An application handling device 1 for rolling hair curlers 2 into hair comprising a grip section 3, at least one shaft 5 projecting from the grip section 3 for the torque-tight reception of a hair curler 2, and a hair retention finger 8, extending in its closed position parallel to the shaft 5, forming with the shaft 5 a hair reception and laid out swivelably with respect to the shaft 5 for opening and closing the hair reception, is characterized thereby that with the application handling device 1 is associated an ionization device 9 with a high-voltage generator 10 and at least one ion-emitting electrode 12 electrically connected to the high-voltage generator 10, the at least one electrode 12 with respect to the disposition of its at least one ion-emitting end 13 is developed for the ion emission directly onto the hair 14 wound about a hair curler 2 retained by the application handling device.

9 Claims, 1 Drawing Sheet

DEVICE FOR APPLICATION OF HAIR CURLERS

CROSS REFERENCE APPLICATIONS

This application claims priority from German application no. 20 2004 003 593.6 filed Mar. 9, 2004.

FIELD OF INVENTION

The invention relates to an application handle for applying hair curlers into hair having a grip section, at least one shaft projecting from the grip section for the torque-tight reception of a hair curler, and a hair retention finger. The hair retention finger in the closed position extends parallel to the shaft and forms with the shaft a hair reception location and is pivotally attached to the shaft for opening and closing the hair retention location.

BACKGROUND OF THE INVENTION

Application handles are employed for rolling heated hair curlers into the hair to be styled and are known in the art. Using application handles, the hair curlers can be heated to a higher temperature than would be possible if the curlers are manually rolled into the hair to be styled. The application handle has a grip section with one or more projecting shafts for the torque-tight reception of a hair curler. The hair curler to be grasped with the device has a number of receptors extending in the axial direction, the number corresponding to the number of shafts. The shaft of the device is inserted into the receptor of a hair curler. A torque-tight connection between the hair curler and the handle is necessary to allow the hair to be wrapped around the curler by turning the handle.

The application handle further includes a pivotally articulated hair retention finger, which forms a hair reception area with the shaft and which extends substantially parallel or parallel to the shaft when the hair retention finger is in the closed position. The hair reception area serves for receiving and holding a strand of hair to be wound around a hair curler. The hair retention finger further serves for retaining the hair curler placed onto the shaft.

It is known that in the process of styling, hair can become electrostatically charged, which not only attracts small dirt and dust particles, but can impair the desired hair styling process. In order to counteract this, known prior art storage cases for hair curlers have an ionization device to coat ions to the outside of the hair curlers in addition to heating the curlers before being rolled into hair. This statically discharges the hair to through these ions when the hair curlers are applied. One such device is disclosed in published patent application US-2005-0000954A1. This measure has led to only limited success.

Building on this discussed prior art, the present invention further develops the application handles described above such that the formation of curls desired from the hair styling process is improved.

This aim is attained according to the present invention with an application handle according to the species cited above, in which the application handle has an ionization device with a high-voltage generator and at least one ion-emitting electrode. The electrode is connected to the high-voltage generator and the at least one ion-emitting end is developed for the ion emission to be directly onto the hair wound about the hair curler retained by the application handle.

SUMMARY OF THE INVENTION

The primary aspect of the present invention is to provide an improved application handle for hair curlers.

Other aspects of this invention will appear from the following description and appended claims, reference being made to the accompanying drawings forming a part of this specification wherein like reference characters designate corresponding parts in the several views.

The application handle has at least one electrode connected electrically to a high-voltage generator. The electrode has at least one ion-emitting end from which ions are emitted directly onto the hair wound about a hair curler during the operation of the ionization device. The ion emitting end(s) of the electrode(s) of the ionization device are disposed such that the ions emitted during the operation of the ionization device are supplied directly to the hair to be styled. During the operation of the ionization device the hair to be styled is subsequently exposed to a virtual ion shower.

The ionization device is usefully operated once the hair has been wound onto the hair curler, in order for the desired static discharge to happen when no more friction is generated which could cause electrostatic charging between the hair and the hair curler. Apart from the property of an electrostatic discharge, which already supports the hair styling process, it was occasionally observed that the quality of the desired curl formation appeared to be better than could be traced to an electrostatic discharge alone.

In one embodiment the ion-emitting end of the electrode is located in the margin region bordering the shaft and is oriented toward the shaft end. An especially intensive ion shower can be provided if several such ion-emitting ends are placed in an annular configuration. For example, three, four or six ion-emitting ends can be disposed at identical angular distance with respect to one another. The grip section usefully includes a switch for turning the ionization device on and off. When the switch is activated, the ionization device is switched on. When the switch is deactivated, it is switched off. The operation of the ionization device can then readily be limited to the instant before the hair curler is detached from the application handle after the hair curler has been rolled into the hair. In principle, it is considered to be sufficient if the hair to be styled is only briefly exposed to an ion shower.

The entire ionization device can be a component of the application handle, so that it also comprises a high-voltage generator as well as a voltage source. In such a case, batteries or rechargeable batteries can be employed as the voltage source. In the latter case it is useful to equip the application handling device with a charging port so that the inductive recharging of the batteries is possible. Equipping the application handle this way is advantageous if the device is a component of a hair setting set with a hair setting case for storing and heating the hair curlers and a support rest for the application handle. The support rest can be equipped at the appropriate position with an inductive charging means for the inductive charging of the batteries.

In principle, if the application handle is associated with a hair setting set, the high-voltage generator can be in a hair setting case. In this case it is necessary to connect the application handle with the hair setting case via an electric cord.

In another embodiment, the at least one shaft retaining the hair curler is driven by a motor so that the rolling of a hair curler takes place under motor driving.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
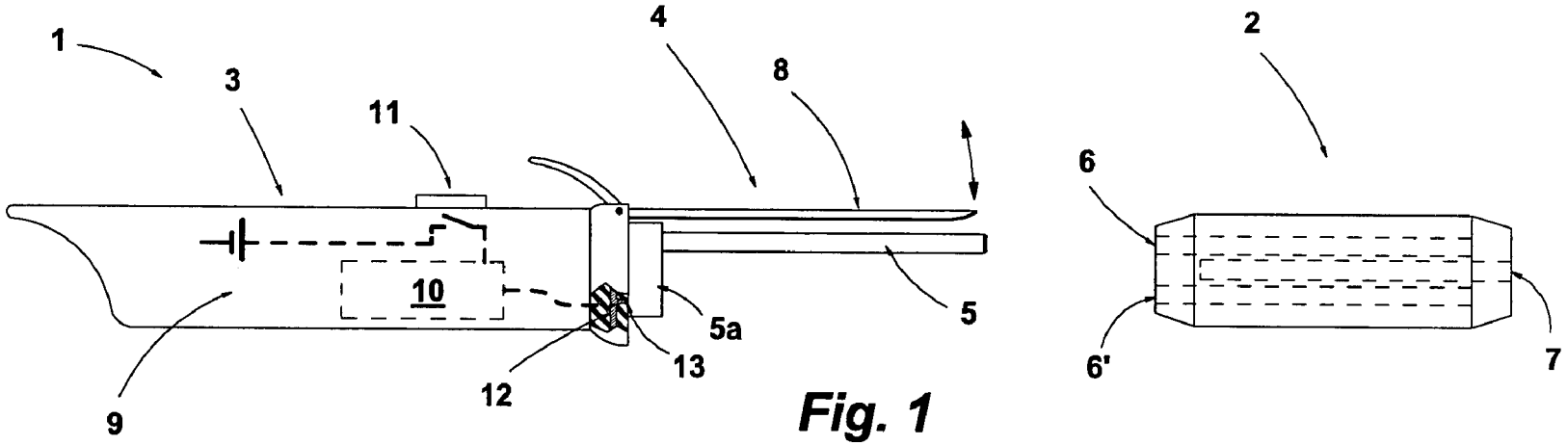
FIG. 1 is a schematic side view of an application handling device and a hair curler.

Referring first to FIG. 1, an application handle 1 is use to wind the hair of a person onto hair curlers 2. The application handle 1 comprises a grip section 3 from which a shaft 4 projects in the manner of a sword. The shaft 4 has a first section 5*a* which has a smaller cross section than the grip section 3 adjoining the shaft part 5 proper. The shaft part 5 has an oval cross sectional area. The shaft 4 and shaft part 5 receives the hair curler 2. The hair curler 2 has two receptors 6, 6' that are complementary to the shaft part 5. This allows the shaft part 5 to be slid into one of the receptors 6, 6' of the hair curler 2, such that the hair curler 2 can be rolled into the hair of a user without the user having to touch the hair curler 2.

The hair curler 2 also has a heating element receptor 7, extending from the side opposite the opening of the receptors 6, 6' into the hair curler 2 so that the hair curler 2 can be placed onto a heating element to be heated. The contour of the heating element is developed complementarily to the heating element receptor 7.

The application handle 1 further comprises a hair retention finger 8, which is pivotally articulated on the grip section 3. In its closed position, shown in FIG. 1, the hair retention finger 8 extends substantially parallel to shaft 4. The hair retention finger 8 is spring biased to its closed position.

The hair retention finger 8 secures the hair curler 2 on the shaft part 5 when the hair curler 2 is pulled from the heating element and holds the end of a strand of hair between the hair retention finger 8 and the shell surface of the hair curler 2 in hair reception area 15 when rolling the same into the hair.

The application handle 1 also has an ionization device 9 with a high-voltage generator 10 which is connected to a voltage source via a push-button switch 11 and an electrode 12 connected to the high-voltage generator 10. The electrode 12 has several ion-emitting ends 13 that are electrode extensions of electrode 12 and are oriented in the direction of the hair curler 2 at the end region of the grip section 3 directed toward the shaft 4. The ion-emitting ends 13 are tapered and are placed on the grip section 3 at the same angular distance with respect to one another. In the depicted embodiment example the electrode 12 comprises three ion-emitting ends 13.

Figure 2:
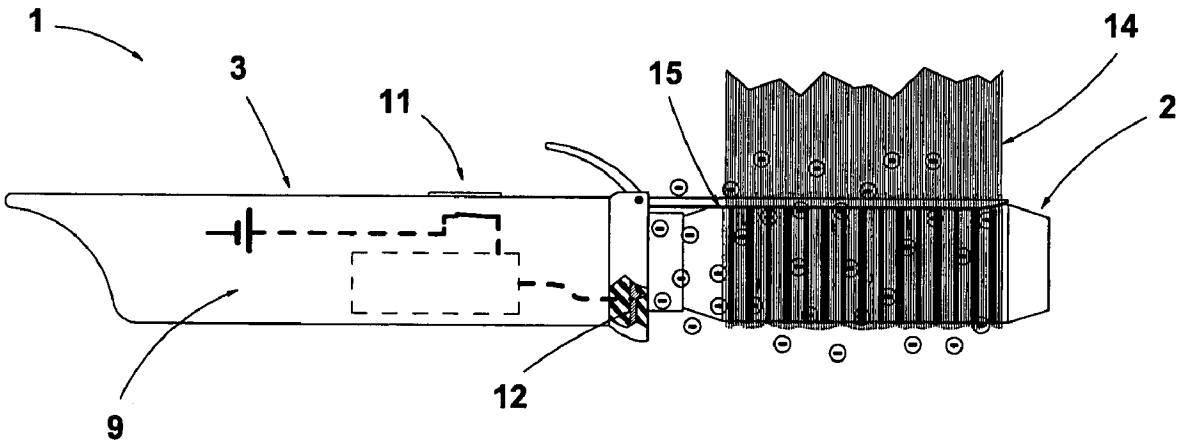
FIG. 2 is a schematic side view of a strand of hair rolled on to the hair curler with the application handle.

After rolling the hair curler 2 into a strand of hair 14 by means of the application handle 1, as is schematically shown in FIG. 2, the strand of hair 14 can be exposed to an ion shower by actuating the push-button switch 11. Upon actuating the push-button switch 11, the ion-emitting ends 13 emit the desired ions in the direction of the hair strand 14 wound by the hair curler 2. This process has the purpose of supporting the hair styling process.

Depending on the implementation of the ionization device 9, it can be operated for the length of time the push-button switch 11 is actuated and emit ions throughout this time interval. Or the push-button switch 11 can be made as a trigger switch and an ion emission takes place over a predefined length of time and that subsequently the ionization device 9 is switched off automatically.

In the depicted embodiment example a rechargeable battery serves as the voltage source for the ionization device, which is connected to an inductive charging port (not shown in the figures). The application handle 1 is a component of a hair setting set, which includes a hair setting case and several hair curlers. The case has a support rest for the application handle 1. The inductive charging device is located within the support rest at a site corresponding to the charging port of the application handle, such that when the application handle 1 is placed into the support rest of the hair setting case the rechargeable battery is charged. In the alternative, the power could be supplied to the high-voltage generator of the application handle by a direct power connection to house current.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

| List of Reference Numbers | |
|---|---|
| 1 | Application handle |
| 2 | Hair curler |
| 3 | Grip section |
| 4 | Shaft |
| 5 | Shaft part |
| 6, 6' | Shaft receptor |
| 7 | Heating element receptor |
| 8 | Hair retention finger |
| 9 | Ionization device |
| 10 | High-voltage generator |
| 11 | Push-button switch |
| 12 | Electrode |
| 13 | Ion-emitting end |
| 14 | Strand of hair |
| 15 | Hair reception area |

I claim:

1. Application handle for rolling hair curlers into hair, said application handle comprising:

a grip section; at least one shaft projecting from the grip section for the torque-tight reception of a hair curler;

a hair retention finger extending in its closed position parallel to the shaft and forming with the shaft a hair reception area;

said hair retention finger pivotally attached to the shaft for opening and closing the hair reception area;

an ionization device having a high-voltage generator and at least one ion-emitting electrode electrically connected to the high-voltage generator; and wherein the ion-emitting electrode is arranged in a margin region of the grip section and wherein several ion-emitting ends, arranged in an annular configuration, are connected with the ion-emitting electrode;

said ion-emitting ends being oriented in the direction towards hair wound about a hair curler placed into the shaft of the application handle.

2. The application handle as claimed in claim 1, wherein the ion-emitting ends are tapered towards their ends.

3. The application handle as claimed in one of claims 1 or 2 wherein the entire ionization device is disposed in the grip section.

4. The application handle as claimed in claim 3, further comprising an electric push-button switch for switching on the ionization device in the proximity of the grip section.

5. The application handle as claimed in one of claims 1 or 2, wherein said application handle is associated a hair setting set with a hair setting container case, serving for storing and heating the hair curlers, and having a support rest for the application handle.

6. The application handle as claimed in claim 5, further comprising rechargeable batteries as a power supply, a charging port for the inductive charging of the rechargeable batteries located such that the charging port is disposed adjoining an inductive charging station within the hair setting container case when the application handle is deposited as specified in the support rest.

7. The application handle as claimed in claim 5, wherein the high-voltage generator is disposed in the hair setting container case and is connected via an electric connection cord with the electrode located in the application handle.

8. The application handle as claimed in claim 5, further comprising an electric push-button switch for switching on the ionization device in the proximity of the grip section.

9. The application handle as claimed in one of claims 1 or 2 further comprising an electric push-button switch for switching on the ionization device in the proximity of the grip section.

* * * * *